US009765677B2

(12) United States Patent
Uchikawa

(10) Patent No.: US 9,765,677 B2
(45) Date of Patent: Sep. 19, 2017

(54) CATALYST CASING-INTEGRATED EXHAUST MANIFOLD AND METHOD FOR MANUFACTURING SAME

(71) Applicant: AISIN TAKAOKA CO., LTD., Toyota-shi, Aichi (JP)

(72) Inventor: Yoshiyuki Uchikawa, Toyota (JP)

(73) Assignee: AISIN TAKAOKA CO., LTD., Toyota-Shi, Aichi (JP)

( * ) Notice: Subject to any disclaimer, the term of this patent is extended or adjusted under 35 U.S.C. 154(b) by 0 days.

(21) Appl. No.: 15/022,885

(22) PCT Filed: Sep. 12, 2014

(86) PCT No.: PCT/IB2014/064457
§ 371 (c)(1),
(2) Date: Mar. 17, 2016

(87) PCT Pub. No.: WO2015/040531
PCT Pub. Date: Mar. 26, 2015

(65) Prior Publication Data

US 2016/0281578 A1 Sep. 29, 2016

(30) Foreign Application Priority Data

Sep. 18, 2013 (JP) ..... 2013-192682

(51) Int. Cl.
*F01N 13/10* (2010.01)
*F01N 13/18* (2010.01)
*F01N 3/28* (2006.01)

(52) U.S. Cl.
CPC ..... *F01N 13/10* (2013.01); *F01N 3/2892* (2013.01); *F01N 13/1877* (2013.01);
(Continued)

(58) Field of Classification Search
CPC .... F01N 3/2892; F01N 13/10; F01N 13/1877; F01N 13/1894; F01N 2450/22; F01N 2470/06; F01N 2530/00
See application file for complete search history.

(56) References Cited

U.S. PATENT DOCUMENTS 6,555,070 B1 4/2003 Krüger
6,651,425 B2 11/2003 Kenyon et al.
(Continued)

FOREIGN PATENT DOCUMENTS

CN 203098017 U 7/2013
DE 19953826 A1 6/2000
(Continued)

OTHER PUBLICATIONS

International Search Report (PCT/ISA/210) issued on Nov. 28, 2014, by the European Patent Office as the International Searching Authority for International Application No. PCT/IB2014/064457.
(Continued)

*Primary Examiner* — Audrey K Bradley
(74) *Attorney, Agent, or Firm* — Buchanan Ingersoll & Rooney PC

(57) ABSTRACT

A catalyst casing-integrated exhaust manifold (manifold converter) includes an exhaust manifold section and a catalyst casing section. The catalyst casing section includes an approximately cylindrically-shaped casing main body holding a catalyst carrier, a conical part interconnecting the casing main body and the exhaust manifold section, and an outlet side shell connected to a downstream side of the casing main body. The exhaust manifold section and the catalyst casing section are formed by pressing a tailored blank by welding at least two metal blanks different in kind of materials and/or having different in thicknesses. In addition, the exhaust manifold section and the conical part of the catalyst casing section are formed of the same metal blank.
(Continued)

The catalyst casing-integrated exhaust manifold and method of manufacturing same can reduce a number of components etc., thereby saving manufacturing cost.

10 Claims, 9 Drawing Sheets

(52) U.S. Cl.
CPC ..... *F01N 13/1894* (2013.01); *F01N 2450/22* (2013.01); *F01N 2470/06* (2013.01); *F01N 2530/00* (2013.01)

(56) References Cited

U.S. PATENT DOCUMENTS

| | | | | |
|---|---|---|---|---|
| 7,162,868 | B2 * | 1/2007 | Funakoshi | F01N 3/08 165/52 |
| 2004/0177609 | A1 | 9/2004 | Moore, III et al. | |
| 2005/0241303 | A1 * | 11/2005 | Nording | F01N 13/102 60/323 |

FOREIGN PATENT DOCUMENTS

| | | | |
|---|---|---|---|
| EP | 0 992 659 | A2 | 4/2000 |
| FR | 2 925 111 | A3 | 6/2009 |
| JP | 58-2412 | A | 1/1983 |
| JP | 09-329020 | A | 12/1997 |
| JP | 2000-204945 | A | 7/2000 |
| JP | 2001090527 | A | 4/2001 |
| JP | 2005-76605 | A | 3/2005 |
| JP | 2006-132408 | A | 5/2006 |
| JP | 2013-123722 | A | 6/2013 |

OTHER PUBLICATIONS

Written Opinion (PCT/ISA/237) issued on Nov. 28, 2014, by the European Patent Office as the International Searching Authority for International Application No. PCT/IB2014/064457.

Office Action (Notice of Ground of Rejection) Aug. 7, 2015, by the Japanese Patent Office in corresponding Japanese Patent Application No. 2013-192682, and an English Translation of the Office Action. (6 pages).

Office Action issued on Jan. 19, 2017, by the German Patent Office in corresponding German Patent Application No. 112014004281.1, and an English Translation of the Office Action. (15 pages).

* cited by examiner

[Fig. 1]
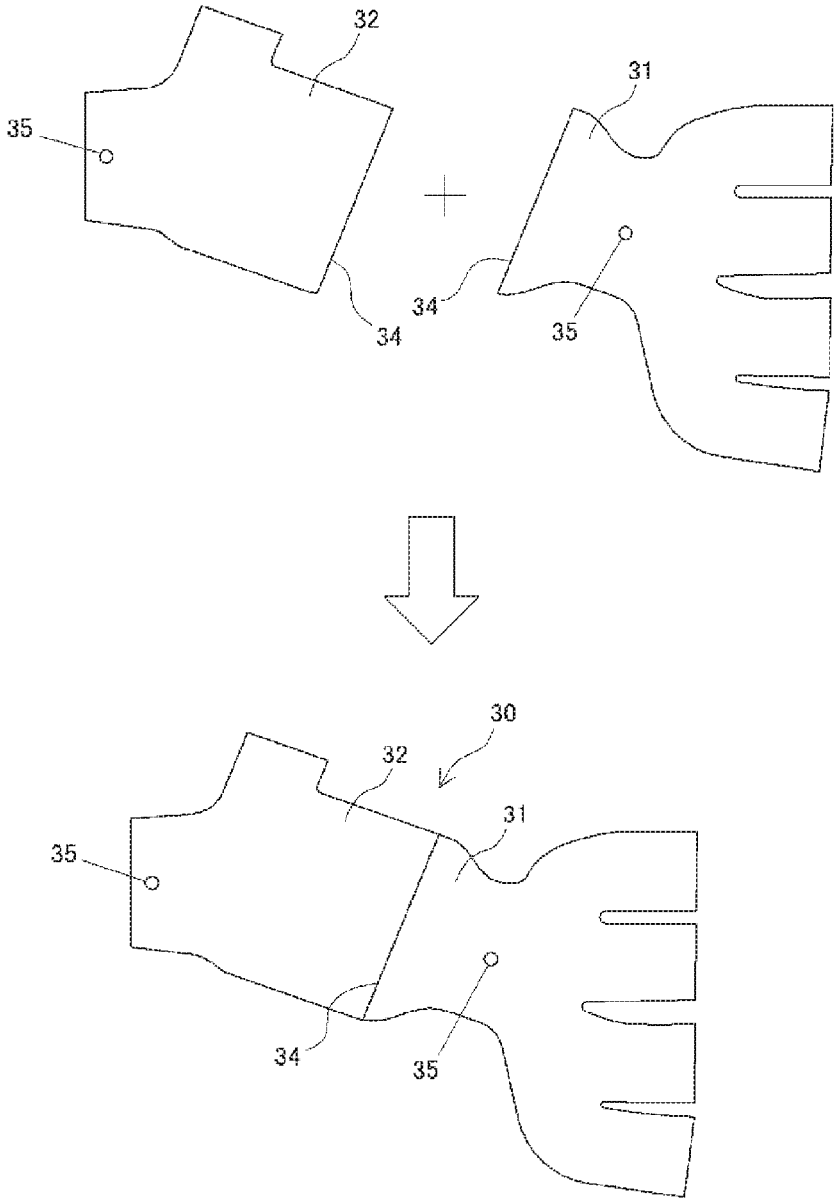

[Fig. 2]
(A)
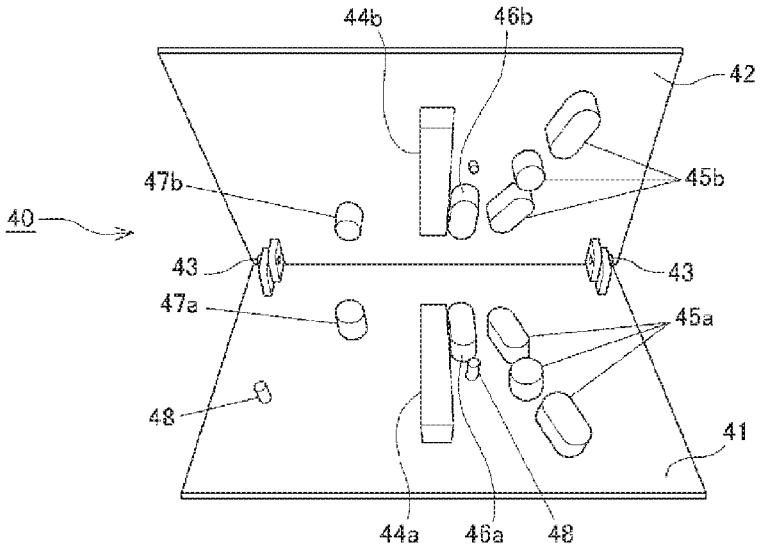
(B)
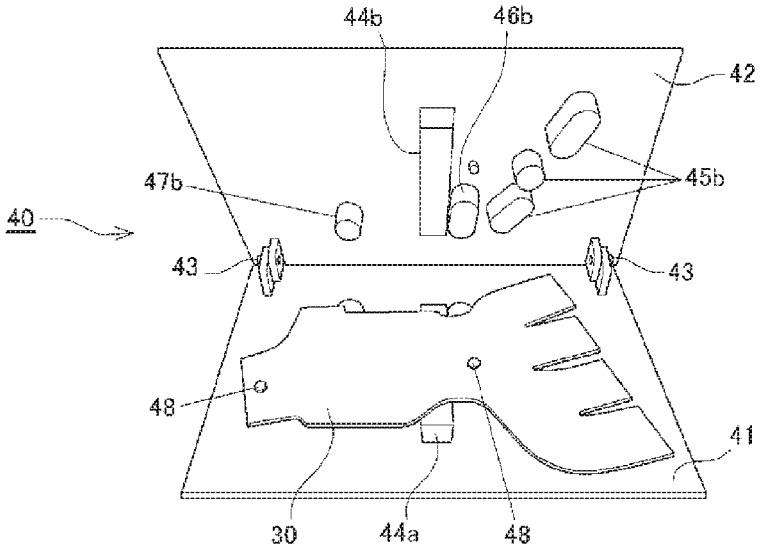

[Fig. 3]
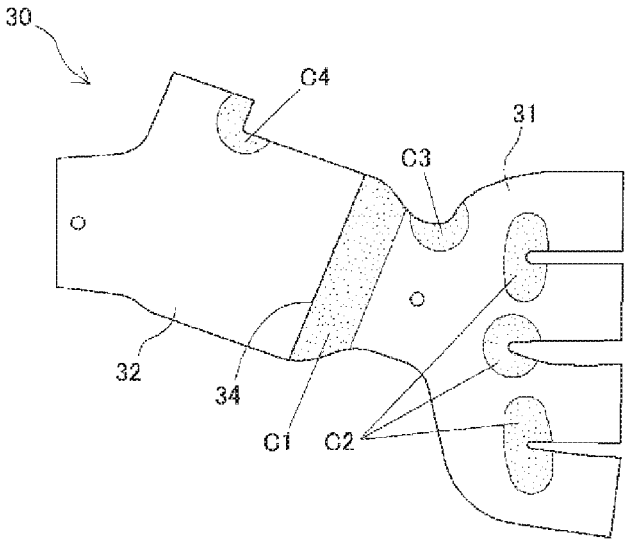
[Fig. 4]
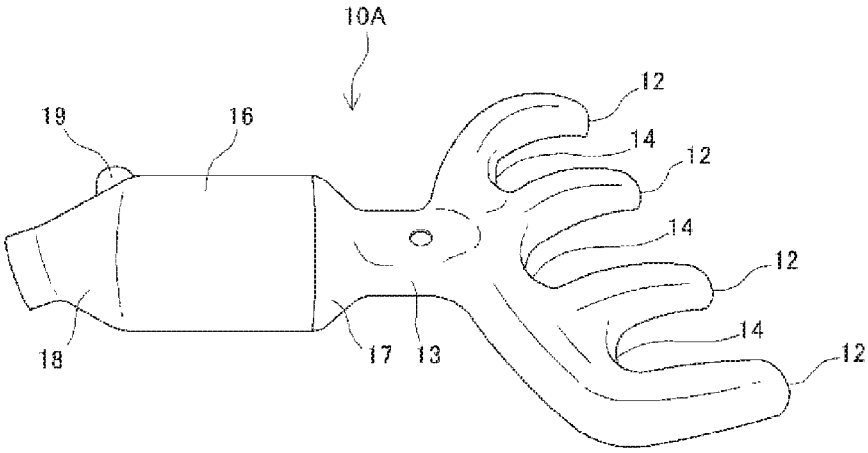

[Fig. 5]
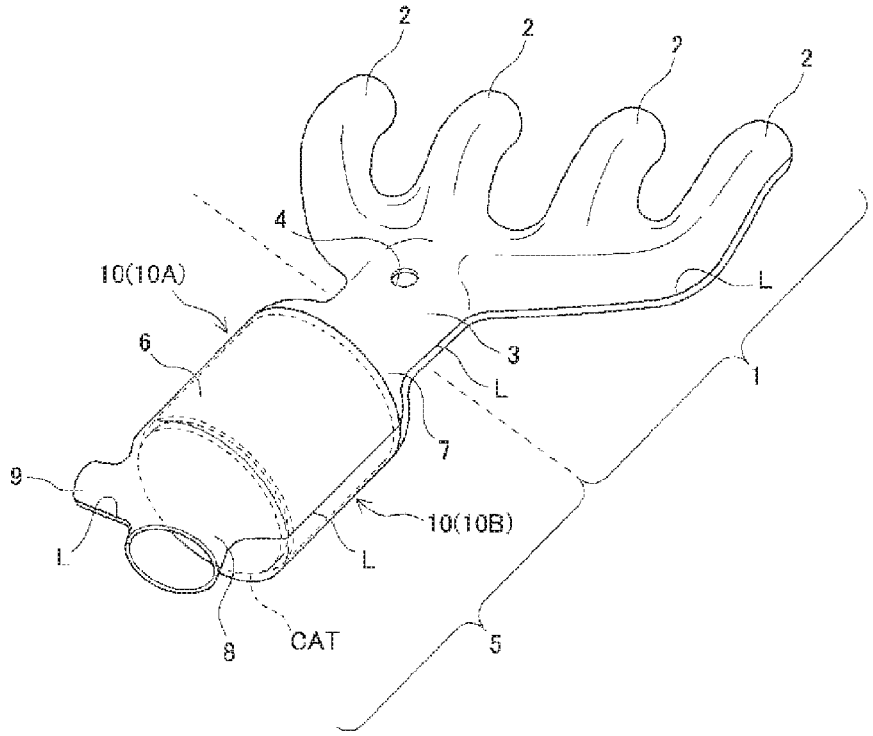
[Fig. 6]
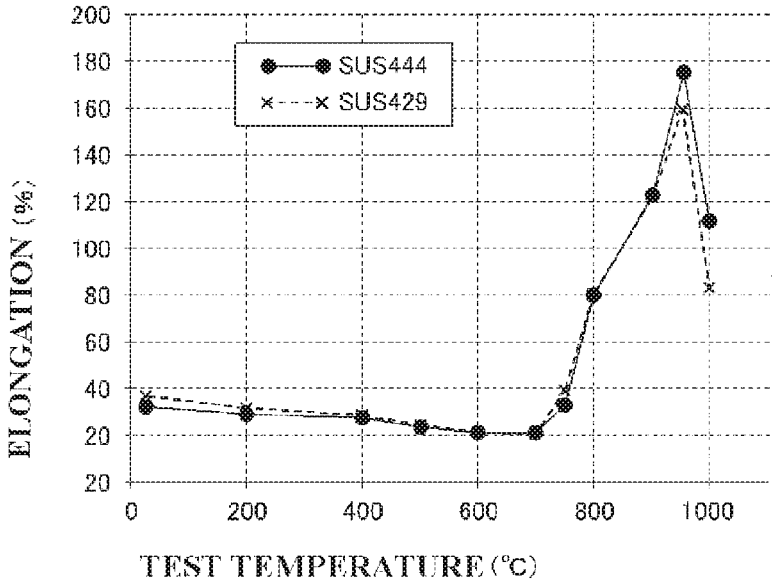

[Fig. 7]
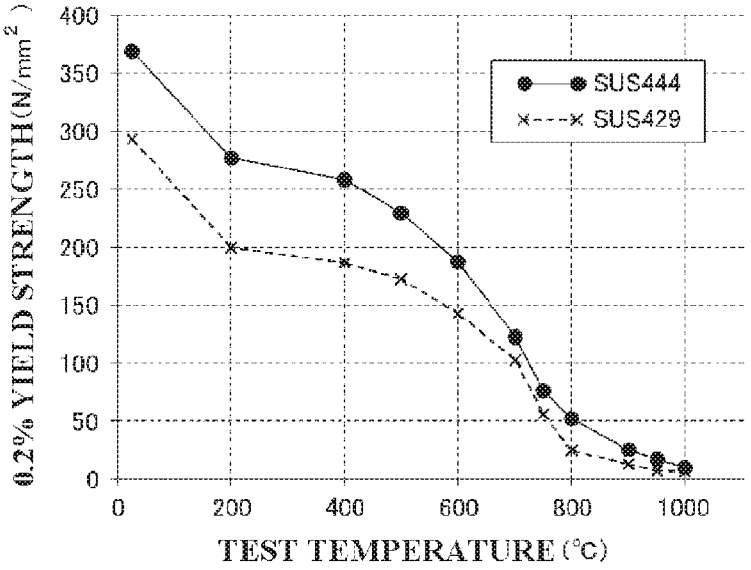
[Fig. 8]
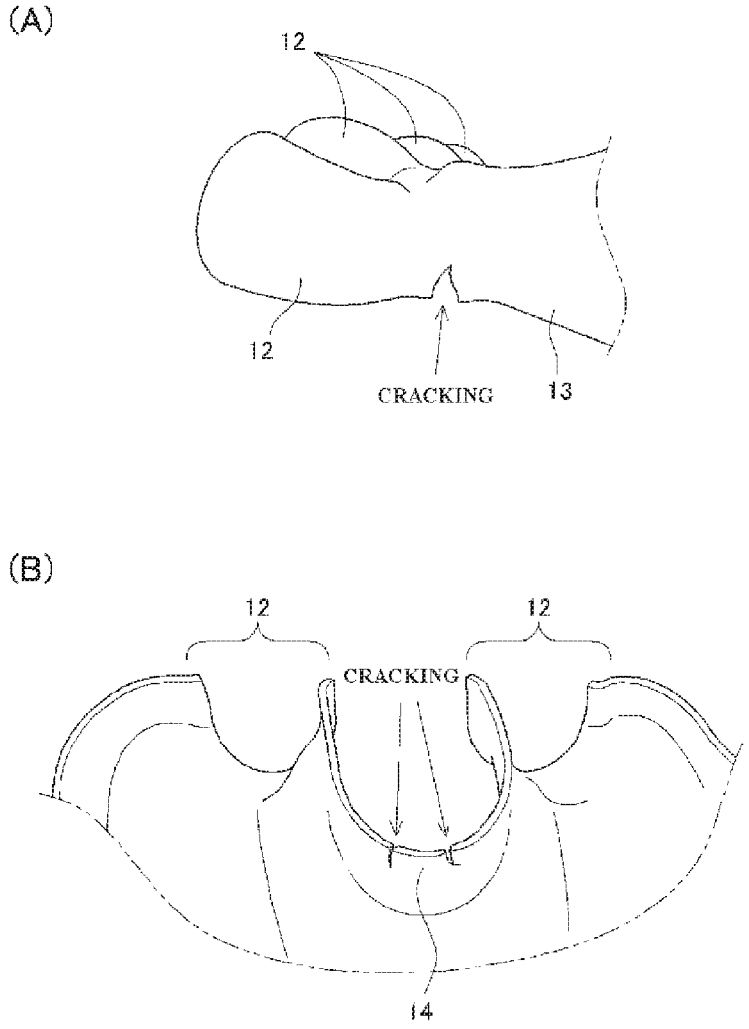

[Fig. 9]
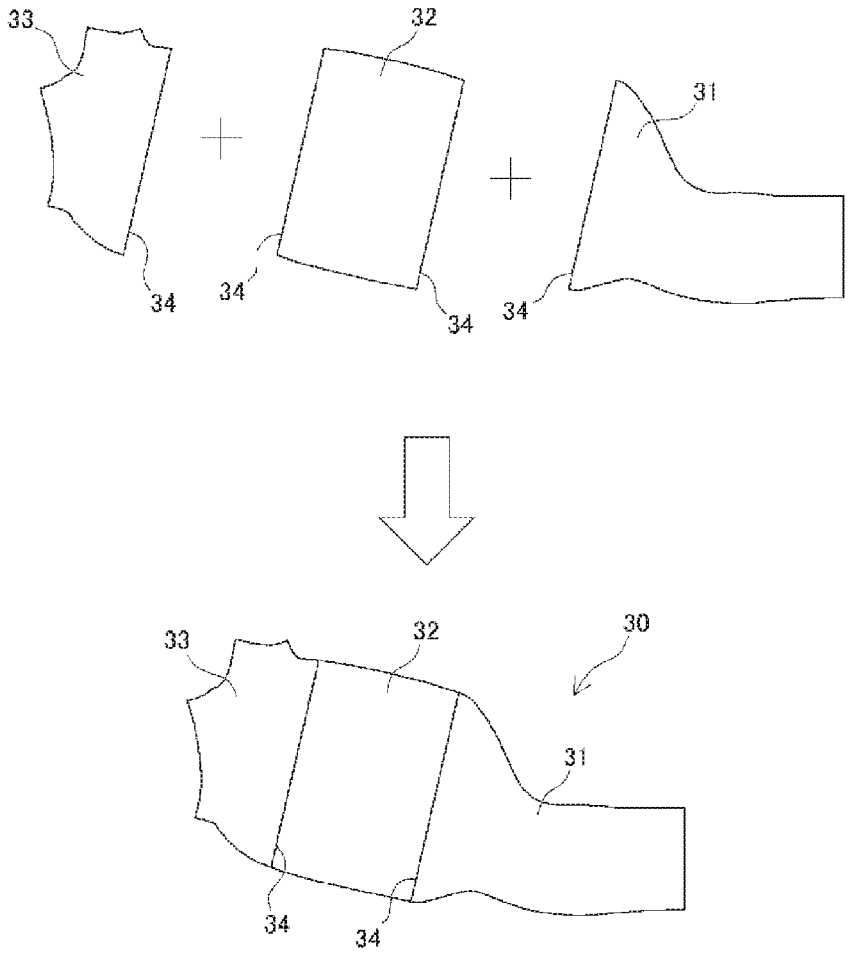
[Fig. 10]
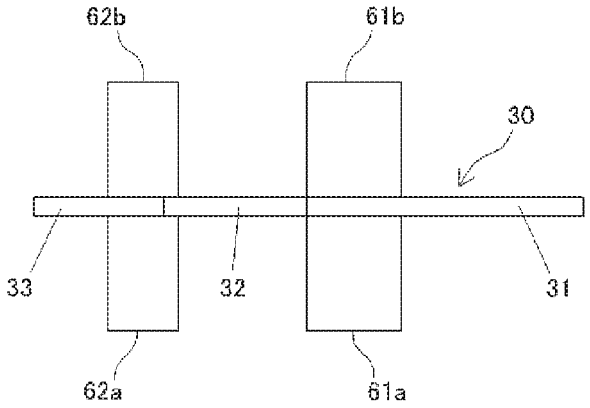

[Fig. 11]
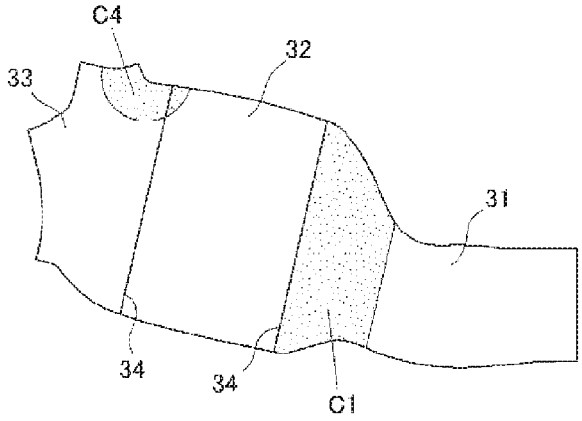
[Fig. 12]
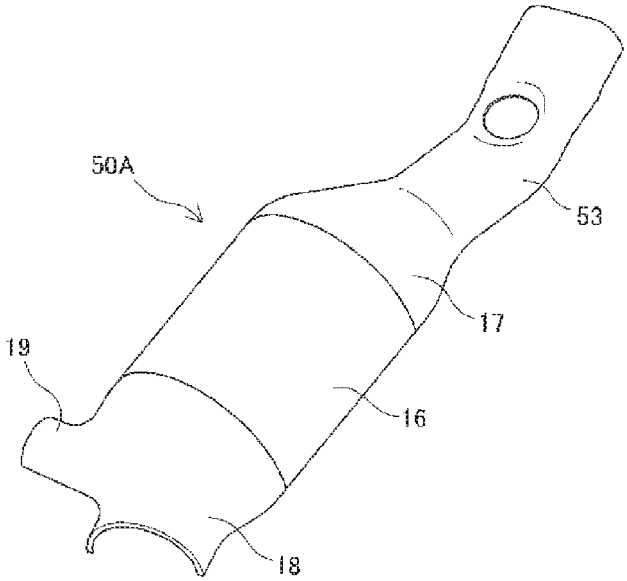

[Fig. 13]
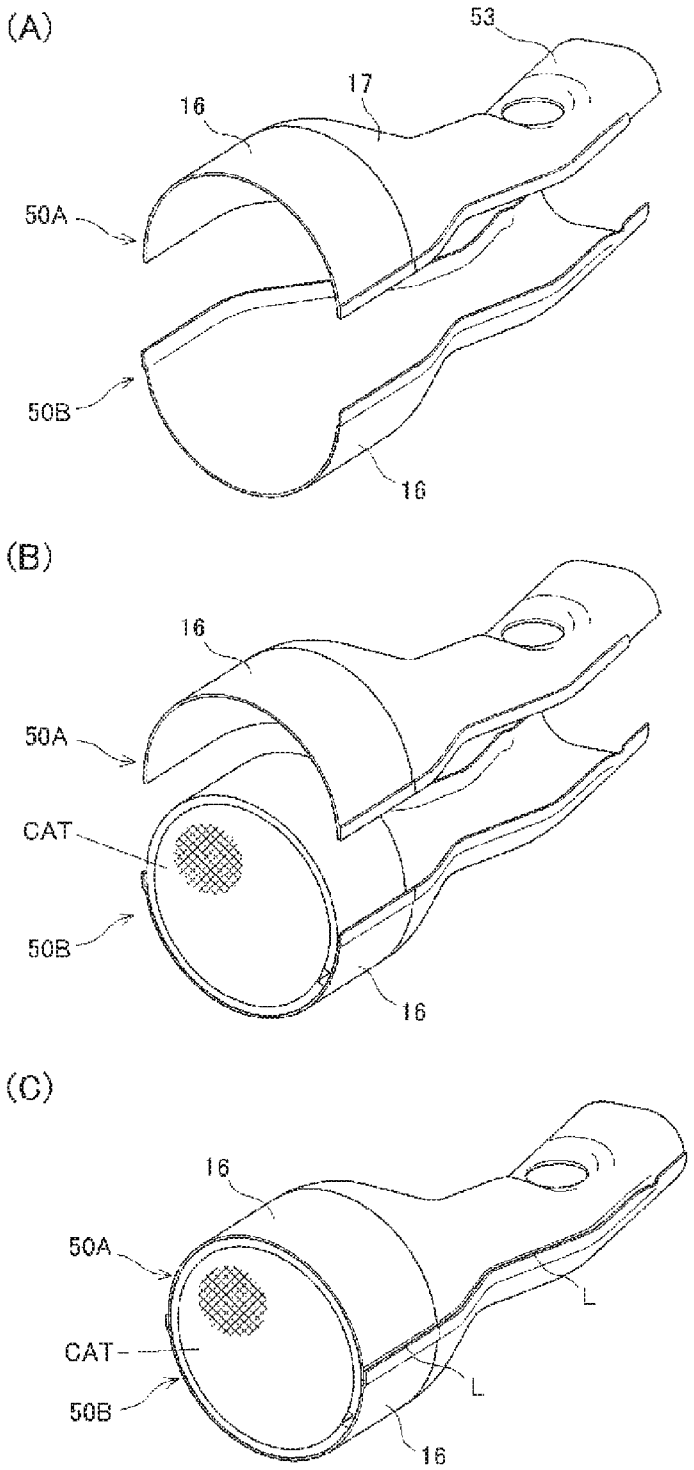

[Fig. 14]
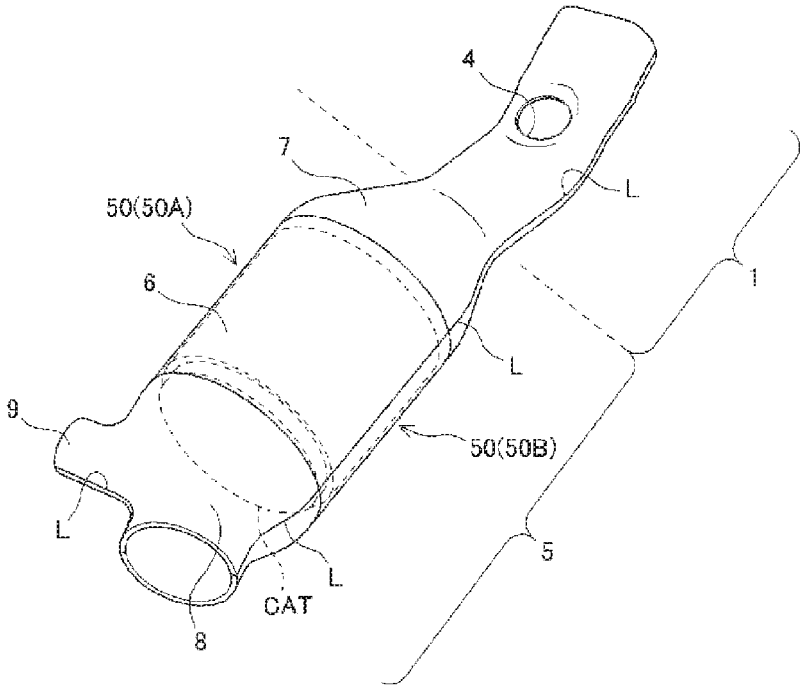
[Fig. 15]
(RELATED ART EXAMPLE)
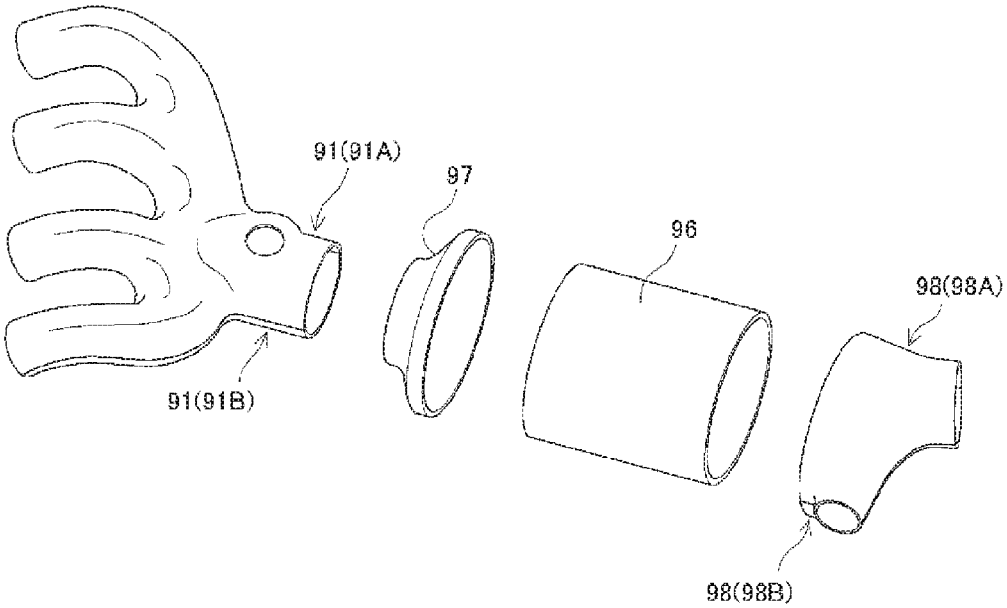

CATALYST CASING-INTEGRATED EXHAUST MANIFOLD AND METHOD FOR MANUFACTURING SAME

CROSS-REFERENCE TO RELATED APPLICATIONS

The present application claims priority based on JP Patent Application No. 2013-192682 filed on Sep. 18, 2013, whose entire disclosure is incorporated herein by reference thereto.

This invention relates to a catalyst casing-integrated exhaust manifold for a vehicle engine and a manufacturing method thereof.

TECHNICAL FIELD

Background

A catalyst casing-integrated exhaust manifold (also called manifold converter): having an exhaust manifold (also abbreviated "ekimani") for collecting exhaust gases from cylinders of an engine; and a catalytic converter directly communicated to the exhaust manifold, is one of exhaust components of an engine for vehicle. For example, FIG. 8 of Patent Literature 1 (JP Patent Kokai Publication No. 2000-204945A) shows a structure of an exhaust system, in which a catalyst casing is disposed directly downstream of an exhaust manifold for a V-typed multiple cylinder engine. Patent Literature 1 discloses a structure of the exhaust manifold in detail, but not a structure of the catalyst casing. The conventional manifold converter is made up of a number of components: for example, as shown in FIG. 15 of the present disclosure, an exhaust manifold shell 91; a casing main body 96; a conical part (inlet side shell) 97; and an outlet side shell 98. The exhaust manifold used to be provided as an integrated cast product in the past. Recently, the exhaust manifolds produced by metal pressing have become popular in order to meet the general demand for lightness in weight, such that, nowadays, the exhaust manifold of the type in which two half shells (91A, 91B), formed by pressing, are welded together to form an entire outer shell of a manifold shell 91, is mainly used. The same applies for the outer side shell 98 disposed on a downstream side of the casing main body 96, such that there may be noticed such designing in which two pressed half shells (98A, 98B) are welded together to form an entire shell thereof. It is noted that a substantially cylindrically-shaped casing main body 96 may be formed by roll-working of a steel plate, and a substantially conical part 97 by pressing of a metal cylinder.

PTL (Patent Literature) 1

JP Patent Kokai Publication No. 2000-204945A

SUMMARY

The following analysis is presented by the present disclosure. In the conventional manifold converter, shown as an example in FIG. 15, as many as six component parts, namely two half shells 91A, 91B forming an exhaust manifold, a conical part 97, a casing main body 96 and half shells 98A, 98B forming an outlet side shell, are used. Because of the larger number of the component parts, a number of welds (weld seams) for interconnection and a weld length are necessarily increased. In addition, an operation for e.g., providing lap tolerances for welds between neighboring parts is also required. Under these circumstances, according to the conventional method for manufacturing a manifold converter, the number of operational steps is increased, so that it is difficult to reduce manufacturing cost.

Moreover, in order to cope with the regulations for exhaust gases, which are becoming more stringent these days, and with increasing requests for reducing fuel costs, a temperature of exhaust gas flowing in a most upstream side of an exhaust system, in particular, the exhaust manifold and the cone-shaped (conical) part in the case of the manifold converter, is unavoidably set to be higher. This high temperature setting leads to increasing of surface temperatures of manifold converter components. There is thus an impending demand for using SUS (stainless steel) having a superior high temperature strength. However, in general, a plate (or sheet) made of SUS, having superior high temperature strength, is difficult to form. Therefore, for using such plate made of SUS (difficult to be formed), as a blank for manifold converter component having a complex shape, establishment of a new forming technique is required in the art.

It is an object of the present disclosure to provide a catalyst casing-integrated exhaust manifold (manifold converter), capable of reducing the number of components thereof and welding therebetween, thereby saving manufacturing cost. It is another object of the present disclosure to provide a method for manufacturing a catalyst casing-integrated exhaust manifold, capable of reducing the number of components thereof using iron-based material that has superior high temperature properties, but difficulty in formability.

Solution to Problem

A first aspect of the present disclosure relates to a catalyst casing-integrated exhaust manifold. The catalyst casing-integrated exhaust manifold includes an exhaust manifold section and a catalyst casing section. The catalyst casing section has a substantially cylindrically-shaped casing main body that holds a catalyst carrier, a conical (cone shaped) part interconnecting the casing main body and the exhaust manifold section, and an outlet side shell connected to a downstream side of the casing main body.

The exhaust manifold section and the catalyst casing section are formed by press-forming of a tailored blank(s), the tailored blank(s) being formed by welding at least two metal blanks which are different in kind of materials and/or different in thicknesses. The exhaust manifold section and the conical part of the catalyst casing section are formed of the same metal blank.

More preferably, in the above catalyst casing-integrated exhaust manifold, the casing main body and the outlet side shell of the catalyst casing section are formed of at least one metal blank which is different from the metal blank(s) forming the exhaust manifold section and the conical part.

According to the first aspect, the exhaust manifold section and the catalytic casing section are derived from the tailored blank(s) and are integratedly pre-formed by press-forming of the tailored blank(s). It is thus possible to reduce a number of components in assembling. On the other hand, due to reduction of the number of components, a number of welds (weld seams) in assembling can be reduced, while a total weld length can also be reduced, so that manufacturing cost may be lowered. Moreover, the exhaust manifold section and the conical part (in the most upstream region) of the catalyst casing section are formed of one of the metal blanks forming the tailored blank, i.e., the same metal blank(s). Hence, as the same metal blanks, an expensive metal blank (s) having superiority etc. in heat resistance is assigned to meet a performance demand at a high level. On the other hand, the casing main body and the output side shell of the catalyst casing section, those being disposed in a midstream and a downstream regions of the catalyst casing section, are formed of at least one of the other metal blank(s) which is different from the metal blank(s) forming the exhaust manifold section and the conical part of the catalyst casing section. Hence, as such metal blank(s), a relatively inexpensive metal blank(s) having less superiority in heat resistance etc. is assigned to meet the cost-saving demand.

A second aspect of the present disclosure relates to a method for manufacturing a catalyst casing-integrated exhaust manifold (the first aspect of the present disclosure). That is the method is for manufacturing a catalyst casing-integrated exhaust manifold including an exhaust manifold section and a catalyst casing section; the catalyst casing section having a substantially cylindrically-shaped casing main body holding a catalyst carrier, a conical part interconnecting the casing main body and the exhaust manifold section, and an outlet side shell connected to a downstream side of the casing main body.

The method comprises:

A) preparing a tailored blank(s) which is formed by welding at least two metal blanks, made of iron-based metal, which are different in kind of materials and/or different in thicknesses, as a metal plate which has a pre-pressing flat plate shape and forms a half shell corresponding to a half shape of a completed catalyst casing-integrated exhaust manifold;

B) entirety-heating the tailored blank(s) up to a high temperature range of 700 to 950 degrees Celsius;

C) bringing a cooling block(s) into contact with at least one local portion including a portion designed to form the conical part through pressing, on the heated tailored blank, so as to cool the at least one local portion and a neighboring area thereof to a low temperature range of 100 to 600 degrees Celsius;

D) press-forming the tailored blank, following the local cooling, so as to impart a three-dimensional form corresponding to the half shell of the catalyst casing-integrated exhaust manifold; and E) butting two of the half shell formed through A) to D), and welding the two half shells at butting portions thereof to complete an overall shape of the catalyst casing-integrated exhaust manifold.

In the second aspect, the tailored blank(s) made of iron-based material, is a precursor to the pressed product (one of two half shells that together corresponding to a completed catalyst casing-integrated exhaust manifold product). In the tailored blank(s), after press-forming, a temperature of at least one cooled part (that is, a cooling block contacting part) forming a conical part (i.e., a part of a metal blank) and the neighboring part(s) thereof are set to a low temperature range (of 100 to 600 degrees Celsius), whereas a temperature(s) of the remaining part(s) is set to a high temperature range (of 700 to 950 degrees Celsius). Under such condition of so-called entirely heating/locally cooling, the tailored blank is press-formed. This is because of the following reason: there are mixed in one press-formed product (one half shell), that is, one part(s) difficult to generate crackings or the like by pressing in a higher temperature range and the other part(s) difficult to generate crackings or the like in a lower temperature range. More specifically, the remaining or not-locally-cooled part(s) by not-contacting with the cooling block(s) has a superior elongation property due to high temperature heating, therefore, even if the tailored blank(s) is so press-formed as to have a relatively complex shape. In contrast, on the cooled part(s) locally-cooled by contacting with the cooling block(s), crackings and the like are easily caused for the following reason: if the iron-based material constituting the tailored blank(s) has a too superior elongation, tensile stress causes local neck resulting in excessive thinning, thereby the crackings and the like easily occur. According to the present disclosure, the elongation of the specific part(s) of the iron-based metal can be suppressed by the local (partial) cooling, while the high yield strength of this part(s) can be maintained. As a result, the tensile stress is hardly transmitted uniformly to the local cooling part(s) and their neighboring part(s), and consequently, in those parts, the local neck due to the tensile stress is hardly generated. Thus, according to the present disclosure, even if in the case of producing half shells forming the catalyst casing-integrated exhaust manifold by press-forming of the iron-based metal(s), through precise temperature controlling (proper to each part), half shell(s) having relatively complex shape(s) can be formed safely and reliably by press-forming. Thus, according to the present method, the catalyst casing-integrated exhaust manifold can be manufactured from a relatively small number of components, using the iron-based material which has superior high temperature strength, but difficulty in formability. On the other hand, since the number of the components can be reduced, it becomes possible to reduce the number of welds in the welding, that is, a final assembling stage, while reducing the total weld length.

It is noted that, in the partial (or local) cooling process, a pair of cooling blocks more preferably contact both of front and back surfaces of the cooling part(s) of the heated tailored blank, that is, the cooled part(s) are sandwiched between the two cooling blocks. It is because the cooling blocks contacting part (to-be-cooled part) and as their neighboring area(s) of the heated tailored blank can be cooled without temperature variations in a short time to the lower temperatures of 100 to 600 degrees Celsius by the cooling blocks contacting from both front and back sides of the heated tailored blank.

Preferably, the cooling blocks are formed of copper. With the cooling blocks formed of copper, not only the cooling (heat removing) performance of the cooling blocks may be improved, but, when contacting the heated tailored blank, the cooling blocks may be released (detached) from the tailored blank, without adhering (by melting) the tailored blank.

In a more preferred exemplary embodiment of the present disclosure, the at least one local portion on the tailored blank, contacted with the cooling block(s) in the local cooling, includes:

a site(s) (C1) adapted to form the conical part after press-forming; and at least one of the following sites:

a site(s) (C2) adapted to form, after the press-forming, a crotch part(s) interconnecting sidewall sections disposed at roots of two neighboring tubular branch parts in the exhaust manifold section;

a site (C3) adapted to form, after press-forming, a connection portion between a root(s) of the tubular branch part(s), disposed at an outermost lateral side(s) of the exhaust manifold section, and a collecting part at which the tubular branch parts are collected together; and a site (C4) adapted to form, after press-forming, a connection portion between a root of a tubular EGR branch part and the casing main body, on the outlet side shell.

In the catalyst casing-integrated exhaust manifold (or its half shells), the above mentioned sites C1 to C4 are typical sites, where crackings etc. are likely generated under a higher temperature condition, since iron-based metal (or generally metal blank) is excessively elongated under that condition, thereby, in press-forming, tensile stress causes a local neck and excessive thinning.

In a more preferred mode of the present disclosure, the iron-based material forming the tailored blank is a metal blank having a specific property that is not quench-hardened, even if rapidly cooled from the (first) high temperature range of 700 to 950 degrees Celsius to the (second) low temperature range of 100 to 600 degrees Celsius. Based on such specific property, the tailored blank may be press-formed without troubles, after the entirety-heating and the local (partial) cooling.

In a third aspect, there is provided a method for manufacturing a catalyst casing-integrated exhaust manifold including an exhaust manifold section and a catalyst casing section; the catalyst casing section having a substantially cylindrically-shaped casing main body holding a catalyst carrier, a conical part interconnecting the casing main body and the exhaust manifold section, and an outlet side shell connected to a downstream side of the casing main body. The method comprises:

A) preparing a tailored blank(s) which is formed by welding at least two metal blanks, which are different in kind of materials and/or different in thicknesses, as a metal plate which has a pre-pressing flat plate shape and forms a half shell corresponding to a half shape of a completed catalyst casing-integrated exhaust manifold;

B) entirety-heating the tailored blank(s) up to a high first temperature range that allows quenching when rapidly cooled at a later press-forming;

C) bringing a cooling block(s) into contact with at least one local portion including a portion designed to form the conical part through press-forming, on the heated tailored blank, so as to cool the at least one local portion and a neighboring area thereof to a low second temperature range which is substantially lower than the first temperature range such that causes quenching when subjected to the press-forming;

D) press-forming the tailored blank, following the local cooling, so as to impart a three-dimensional form corresponding to the half shell of the catalyst casing-integrated exhaust manifold; and E) butting two of the half shell formed through A) to D), and welding the two half shells at butting portions thereof to complete an overall shape of the catalyst casing-integrated exhaust manifold.

With the catalyst casing-integrated exhaust manifold, according to the present disclosure, the number of components thereof can be reduced as compared with those of the conventional one, while the number of welds etc. can be reduced, thereby saving manufacturing costs.

With the method for manufacturing a catalyst casing-integrated exhaust manifold, according to the present disclosure, it is possible to produce a catalyst casing-integrated exhaust manifold formed of a smaller number of components, using particular (e.g., iron-based) material(s) which has superior high temperature properties, but difficulty in formability.

BRIEF DESCRIPTION OF DRAWINGS

FIG. 1 is a plan view showing a tailored blank used in Exemplary Embodiment 1 of the present disclosure.

FIGS. 2(A) and 2(B) show a partial cooling device used in Exemplary Embodiment 1, where FIG. 2(A) is a perspective view of the device before setting the tailored blank thereon and FIG. 2(B) is a perspective view of the device after setting the tailored blank thereon.

FIG. 3 is a plan view showing temperature distribution of the entirety-heated and partially cooled tailored blank according to Exemplary Embodiment 1.

FIG. 4 is a perspective view schematically showing one of half shells formed by press-forming.

FIG. 5 is a perspective view showing the two half shells jointed together.

FIG. 6 is a graph showing properties of elongation versus temperature of stainless steels used.

FIG. 7 is a graph showing properties of 0.2% yield strength versus temperature of stainless steels used.

FIGS. 8(A) and 8(B) are perspective views showing a reference case in which crackings etc. occur on local portions.

FIG. 9 is a plan view showing a tailored blank used in Exemplary Embodiment 2 of the present disclosure.

FIG. 10 is a schematic side view showing cooling blocks contacting the heated tailored blank.

FIG. 11 is a schematic plan view showing temperature distribution of the entirety-heated and partially cooled tailored blank in Exemplary Embodiment 2.

FIG. 12 is a schematic perspective view showing one of half shells formed by press-forming.

FIGS. 13(A), 13(B) and 13(C) are partial broken perspective views for illustrating steps until the two half shells are jointed together with retaining a catalyst carrier.

FIG. 14 is a perspective view showing the two half shells jointed together.

FIG. 15 is a schematic exploded perspective view showing a conventional manifold converter.

PREFERRED MODES

Certain preferred exemplary embodiments of the present disclosure will now be explained with reference to the drawings. It is observed that FIGS. 1 to 8 are generally directed to Exemplary Embodiment 1, and FIGS. 9 to 14 are generally directed to Exemplary Embodiment 2.

Exemplary Embodiment 1

FIG. 5 shows a completed form of a catalyst casing-integrated exhaust manifold (manifold converter) according to Exemplary Embodiment 1. Referring to FIG. 5, the manifold converter is formed of an exhaust manifold section 1 disposed on an upstream side of an exhaust system and a catalyst casing section 5 disposed on a downstream of the exhaust system. The exhaust manifold section 1 and the catalyst casing section 5 are connected each other in series. The exhaust manifold section 1 includes four branch pipes 2 in which exhaust gases from cylinders (not shown) of a four-cylinder engine are introduced, and a collecting pipe 3 communicating with the four branch pipes 2. An oxygen sensor fitting part 4 having a through hole shape is usually provided in the collecting pipe 3. The catalyst casing section 5 is provided with a substantially cylindrically-shaped casing main body 6 for retaining a catalyst carrier CAT; a conical part 7 (inlet side shell) communicating the casing main body 6 with the collecting pipe 3 of the exhaust manifold section 1; and an outlet side shell 8 connected to a downstream side of the casing main body 6.

To assemble the manifold converter as shown in FIG. 5, two half shells 10 (an upper half shell 10A and a lower half shell 10B) are jointed each other. Each of the two half shells has a half-divided shape of a shape of the completed manifold converter. More specifically, two tailored blanks, as starting work, are press-formed to form the two shells 10A, 10B, which are then welded together to complete the manifold converter. FIG. 4 shows a schematic view showing one of the two half shells of the manifold converter, that is, the upper half shell 10A. Although the following explanation, made with reference to FIG. 4, is directed to the upper half shell 10A, it is to be understood that the explanation applies to the lower half shell 10B as well.

The upper half shell 10A, which is a press-formed product, includes four tubular (tunnel-shaped) branch parts 12 branched from a collecting part 13. These four tubular branch parts 12 and the collecting part 13 form exhaust manifold forming portions (12, 13) of the upper half shell. Each of the tubular branch parts 12, which has a substantially semi-circular arc shaped transverse cross-section. Once the two upper and lower half shells 10A, 10B are jointed together, the branch parts 12 form a part of the branch pipes into which exhaust gases from the cylinders of the four-cylinder engine are introduced. At (or by) the collecting part 13, four ends (base side ends) of the four branch parts 12 are collected (merged) into one. Once the upper and lower half shells 10A, 10B are jointed together, the collecting part 13 forms a part of collecting pipe 3. In the collecting pipe 3, all exhaust gases from the four engine cylinders join into one. The half shell 10A have three crotch parts 14, each of which is formed to bridge sidewall sections disposed at root ends of the two neighboring tubular branch parts 12. In other words, the crotch parts 14 are a so-called "curved interconnect profile part" interconnecting the neighboring sidewalls (see FIG. 8(B)).

The upper half shell 10A, as a press-formed product, includes a first half-conical part 17, contiguous to the collecting part 13, a half-cylindrically shaped part 16, contiguous to the half-conical part 17, and a second half-conical part 18 contiguous to the trailing end of the half-cylindrically shaped part 16. These three sections together make up a catalytic casing forming section (16, 17, 18) of the half shell. The first half-conical part 17 is the site that forms the conical part 7 when the upper and lower half shells 10A, 10B are unified together (conical part forming portion). The half-cylindrically shaped part 16 is the site that forms the casing main body 6 when the upper and lower half shells 10A, 10B are unified together (casing main body forming portion). The second half-conical part 18 is the site that forms the outlet side shell 8 when the upper and lower half shells 10A, 10B are unified together. It is noted that a tubular (tunnel-shaped) EGR (Exhaust Gas Recirculation) branched part 19 is provided on the second half-conical part 18. This tubular EGR ranched part 19 is a site that forms a communication EGR port 9 in the form of a short pipe for coupling to an EGR pipe, not shown, when the upper and lower half shells 10A, 10B are unified together (see FIG. 5).

The half shells 10A, 10B for the manifold converter, shown in FIG. 4 (and FIG. 5), may be fabricated through a tailored blank preparing step, an entirety-heating step, a partial (local) cooling step and a press-forming step. It is noted that the following explanation is made of the upper half shell 10A.

<Tailored Blank Preparing Step>

As an iron-based metal sheet (assembly), shaped in a planar form of the half shell prior to the press-forming, a tailored blank is prepared. Specifically, a first iron-based metal blank (first metal sheet member) 31, formed to the shape of approximately one-half in plan of the upper half shell 10A prior to the press-forming, and a second iron-based metal blank (second metal sheet member) 32, formed to the shape of approximately the remaining one-half in plan of the upper half shell 10A prior to the press-forming, are prepared, as shown in FIG. 1. The first and second metal blanks 31, 32 are jointed together (or overlapped) and welded, preferably laser-welded, at a jointing portion 34 to interconnect the metal blanks 31, 32 to form a tailored blank 30. It is noted that, in the subject exemplary embodiment, a SUS444 stainless steel sheet of 2.0 mm thick, is used as the first iron-based metal blank 31, while a SUS429 stainless steel sheet of 1.5 mm thick, is used as the second iron-based metal blank 32.

It is noted that SUS444 and SUS429 are classified under "ferritic stainless steel" in JIS (Japanese Industrial Standards) G4305 (Cold rolled stainless steel plates, sheets and strip). Table 1 below shows compositions of elements other than iron in these stainless steel products (% denotes % by weight):

TABLE 1

| COMPOSITIONS OF ELEMENTS OTHER THAN IRON | SUS444 CONTENT (%) | SUS429 CONTENT (%) |
|---|---|---|
| Cr | 17-20 | 14-16 |
| Mo | 1.75-2.50 | — |
| C | no more than 0.025 | no more than 0.12 |
| Si | no more than 1.00 | no more than 1.00 |
| Mn | no more than 1.00 | no more than 1.00 |
| P | no more than 0.04 | no more than 0.04 |
| S | no more than 0.03 | no more than 0.03 |
| N | no more than 0.025 | — |
| OTHERS | Ti, Nb or Zr, or combination of those: 0.80 at most | |

FIGS. 6 and 7 depict graphs showing characteristics of SUS444 and SUS429 materials. Specifically, FIG. 6 shows an elongation characteristic (%) attendant on changes in temperature, while FIG. 7 shows the 0.2% yield strength ($N/mm^2$) attendant on changes in temperature. These characteristics were measured in accordance with JIS-G0567 (Methods of elevated temperature tensile test for steels and heat-resisting alloys) and JIS-Z2241 (Metallic materials-Tensile testing-Method of test at room temperature) which is the standard referred to in JIS-G0567. In particular, the "elongation" of FIG. 6 was measured in accordance with the explanation in JIS-Z2241 columns 3.3 and 3.4. The "yield strength" was measured in accordance with the yield strength (offset method) as stated in column 3.10.3 in JIS-Z2241. The "0.2% yield strength" in FIG. 7 means the stress when the plastic elongation has become equal to a prescribed percentage value referred to a gauge length, which is 0.2% in the present instance. It is noted that, with SUS444 used in the subject exemplary embodiment, the elongation at 200 degrees Celsius was 29%, 0.2% yield strength at 200 degrees Celsius was 277 $N/mm^2$; the elongation at 800 degrees Celsius was 80%, 0.2% yield strength at 800 degrees Celsius was 53 $N/mm^2$; with SUS429 used in the subject exemplary embodiment, the elongation at 200 degrees Celsius was 30%, 0.2% yield strength at 200 degrees Celsius was 200 $N/mm^2$; the elongation at 800 degrees Celsius was 80%, and 0.2% yield strength at 800 degrees Celsius was 25 $N/mm^2$.

It is noted that the iron-based metal, used in the present disclosure, is an unquenchable (unhardenable) metal in the sense that, even in case it is rapidly cooled through the partial cooling process, preceded by the entirety-heating process, as later explained, the rapidly cooled portion of the blank is not quench-hardened. For this reason, as the component metal of the tailored blank 30, ferritic stainless steel, among stainless steel species, is most preferred.

<Entirety-Heating Process>

The tailored blank 30, formed of stainless steel, is then charged into a heating device, such as an electrical heating furnace or a gas heating furnace, and heated in its entirety to an elevated temperature of 700 to 950 degrees Celsius, preferably 750 to 900 degrees Celsius and more preferably to 750 to 850 degrees Celsius. In the subject exemplary embodiment, the tailored blank 30 in its entirety was heated until its surface temperature was approximately 800 degrees Celsius. Note that, if the heating temperature in the entirety-heating process is less than 700 degrees Celsius, the rate of elongation of stainless steel can not be raised to a significant level, in which case the meaning of heating would be lost. If conversely the heating temperature exceeds 950 degrees Celsius, the tailored blank 30 becomes excessively softened, so that it undesirably becomes collapsed during press-forming.

<Partial (Local) Cooling Process>

Then, certain portions of the tailored blank 30, taken out from the heating device, are cooled. Specifically, one or more local portions of the heated blank 30, namely sites C1 to C4 in FIG. 3, are brought into contact with cooling blocks, as later explained, whereby the portions of the blank, contacted by the cooling blocks, as well as neighboring portions thereof, are cooled down to lower temperatures of 100 to 600 degrees Celsius, preferably 100 to 500 degrees Celsius, more preferably 100 to 400 degrees Celsius and most preferably 100 to 300 degrees Celsius. In the subject exemplary embodiment, the portions of the blank, contacted with the cooling block(s), were cooled down to approximately 200 degrees Celsius. It is noted that, if the cooling temperature during the partial cooling process is of the order of 100 to 600 degrees Celsius, the yield strength of the metal can be maintained at a higher level, while elongation of the metal is suppressed, so as to prevent root cracking (see FIG. 8(A)) or cracking at the crotched part 14 (see FIG. 8(B)) during the press-forming. It is observed that, if the local sites of the blank are cooled to a temperature lower than 100 degrees Celsius, other portions of the blank which it is not desired to cool would concomitantly be cooled, which is not desirable. On the other hand, the local sites of the blank are cooled only to a range not higher than 600 degrees Celsius, because if the blank is cooled to a temperature higher than 600 degrees Celsius it becomes difficult to develop a difference in metal properties from those which are heated in the elevated temperature range between 700 and 950 degrees Celsius.

In the subject exemplary embodiment, the tailored blank 30 was partially cooled using a partial cooling device 40 shown in FIG. 2(A). Referring to FIG. 2(A), the partial cooling device 40 includes a fixed plate 41, as a stationary base block, and a movable plate 42, attached to the fixed plate 41 for rotation relative thereto via a hinge structure 43 comprised of paired left and right hinges. A plurality of, herein six, cooling blocks (44*a*, 45*a*, 46*a*, 47*a*) are fixedly mounted at preset locations on the upper surface of the fixed plate 41. In similar manner, the same number of, herein six, cooling blocks (44*b*, 45*b*, 46*b*, 47*b*), are fixedly mounted at preset locations on the lower surface of the movable plate 42. The six cooling blocks (44*a*, 45*a*, 46*a*, 47*a*) of the fixed plate 41 are in an one-for-one mating relationship with respect to the six cooling blocks (44*b*, 45*b*, 46*b*, 47*b*) of the movable plate 42, so that, when the movable plate 42 is made to approach the fixed plate 41, upper and lower mating cooling blocks will face to each other.

The sum total of 12 cooling blocks, shown in FIG. 2(A), may be classified into four groups (first to fourth groups) depending on the objectives or the locations of cooling. The first group is comprised of upper and lower elongated cooling blocks 44*a*, 44*b*, forming a pair, and the second group is comprised of three upper and three lower cooling blocks 45*a*, 45*b*, forming three pairs, thus totaling at six cooling blocks. The third group includes upper and lower cooling blocks 46*a*, 46*b*, forming another pair, neighboring to the elongated cooling blocks 44*a*, 44*b*, and having oblong end faces. The fourth group includes the upper and lower cooling blocks 47*a*, 47*b*, forming still another pair, and having circular end faces.

The cooling blocks (44*a*, 44*b* to 47*a*, 47*b*) are preferably formed of metal or ceramics, in particular copper. In the subject exemplary embodiment, all of the cooling blocks are formed of copper. With the cooling blocks formed of copper, not only the cooling performance of the cooling blocks may be improved, but also the cooling blocks, brought into contact with the heated blank 30, may be prevented from adhering or becoming fused to the tailored blank 30. In the case of the cooling blocks (44*a* to 47*a*) of the fixed plate 41, it is their upper end faces that are contacted with the tailored blank 30, whereas, in the case of the cooling blocks (44*b* to 47*b*) of the movable plate 42, it is their lower end faces that are so contacted. The shape and/or the area of the sites to be partially cooled may be adjusted depending on the shape setting and/or the area setting of the respective contact surfaces. The heat capacity (and hence the cooling performance) of the cooling blocks may also be adjusted depending on the height (thickness) setting of the cooling blocks.

At least two positioning pins 48 are mounted upright on the fixed plate 41. These two positioning pins 48 are engaged in at least two mating positioning openings 35 (see FIG. 1) bored at the outset in the tailored blank 30 for positioning the tailored blank 30 relative to the fixed plate 41 and the group of the cooling blocks (44*a* to 47*a*).

In partially cooling the tailored blank 30, using the partial cooling device 40, the tailored blank 30, heated to an elevated temperature by the entirety-heating process, is set on the cooling blocks (44*a* to 47*a*) of the fixed plate 41, as shown in FIG. 2(B). The movable plate 42 is turned quickly so as to approach the fixed plate 41 to clinch the tailored blank 30 in-between the group of the cooling blocks (44*a* to 47*a*) of the fixed plate 41 and the group of the cooling blocks (44*b* to 47*b*) of the movable plate 42. That is, the tailored blank 30 is brought into contact with the cooling blocks from above and from below. After lapse of the time (e.g., 3 to 5 sec) necessary for the contact portions with the cooling blocks to be cooled from ca. 800 degrees Celsius to ca. 200 degrees Celsius, the movable plate 42 is quickly removed apart from the fixed plate 41, and the tailored blank 30, now partially cooled, is transported from the partial cooling device 40 to a pressing device, not shown.

FIG. 3 shows surface temperature states of the tailored blank 30 immediately following the removal of the tailored blank 30 from the partial cooling device 40, that is, immediately after the partial cooling. Specifically, FIG. 3 shows the sites of the blank directly contacted with the cooling blocks and neighboring areas where the temperature is lower, that is, relatively low temperature sites (C1 to C4), with a flecked (dotted) pattern. The open (white) region in the tailored blank 30 denotes sites where the temperature is still high. In FIG. 3, the first low-temperature site C1 comes from direct contact with the elongated cooling blocks 44*a*, 44*b*, and is destined to form the first half-conical part 17 (conical part forming portion) later on as a result of subsequent press-forming. It is noted that the elongated cooling blocks 44*a*, 44*b* are contacted with the first metal blank 31 at a location along the jointing portions 34 of the tailored blank 30. The second relatively low temperature sites C2, there being three such sites, come from contact with three pairs of the cooling blocks 45*a*, 45*b*, and are destined to form, by subsequent press-forming, the crotch parts 14 interconnecting sidewall sections located at root portions of the respective two neighboring tubular branch parts 12.

The third relatively low temperature site C3 comes from contact with the cooling blocks 46*a*, 46*b* having an oblong end face shape. The site C3 is destined to form, by subsequent press-forming, a connection region between the root of the tubular branch part 12, located at a lateral outer most side of the exhaust manifold forming portion, and the collecting part 13 that forms the converging portion of the four tubular branch parts 12.

The fourth relatively low temperature site C4 comes from contact with the cooling blocks 47*a*, 47*b* having the circular end face shape, and is destined to form, by subsequent press-forming, a connection region between the root of the tubular EGR branched part 19 and the half-cylindrically shaped part 16 (casing main body forming section).

<Press-Forming Process>

Then, using a forming die set, made up of a fixed die and a movable die, not shown, routine press-forming is carried out for the tailored blank 30 that comes from the entirety-heating followed by the partial cooling. This yields a three-dimensional form composed by the four tubular branch parts 12, collecting part 13, first half-conical part 17, half-cylindrically shaped part 16, second half-conical section 18 and the tubular EGR branched part 19, and hence an upper half shell 10A of the manifold converter is produced. The press-formed product of the subject exemplary embodiment is free from crackings or the like in any sites including the crotch parts 14, so that a product optimum in dimensional accuracy despite shape complexities may be produced.

<Case of Reference>

The following briefly describes an inconvenience that would be encountered if the above mentioned partial cooling process is not carried out and the tailored blank 30 is press-formed immediately after the entirety-heating to produce the half shell. In such case, a cracking(s) is likely to be produced in the circumferential direction in the half-conical part 17 of the half shell, in particular in a portion of the half-conical part 17 which is close to the collecting part 13. Moreover, a cracking(s) tends to be produced in the crotch parts 14 interconnecting the sidewall sections disposed at the roots of any given two of the neighboring tubular branch parts 12, as shown in FIG. 8(B). Such crack(s) also tends to be produced in a connection region between the root of the outermost one of the four tubular branch parts 12 and the collecting part 13, as shown in FIG. 8(A), or in a connection region between the root of the tubular EGR branched part 19 and the casing main body forming part 16. These sites are complex in shape and moreover are curved with a large extent of curving (or buckling). Therefore, if they are press-formed while they remain heated to elevated temperatures, they are excessively reduced in thickness and hence tend to cause the cracking(s).

<Process of Catalyst Carrier Retention and Welding>

When the upper half shell 10A and the lower half shell 10B are prepared by the above mentioned steps, a catalyst carrier CAT in the form of substantially a column is set in the hollow interior of the half-cylindrically shaped parts 16 of the two half shells 10A, 10B, and the two half shells 10A, 10B are combined (assembled) with each other, as shown in FIG. 5. At this time, the catalyst carrier CAT is compressed from outside the half-cylindrically shaped parts 16 of the two half shells 10A, 10B, using a clamp jig, not shown, thereby bringing the inner peripheral surfaces of the half-cylindrically shaped parts 16 into intimate contact with the outer peripheral surface of the catalyst carrier CAT. While the state of the intimate contact is maintained, the two half shells 10A, 10B are welded (preferably all around) on a butting line L, thereby completing the overall shape of the manifold converter.

Advantageous Effect of Exemplary Embodiment 1

According to the subject exemplary embodiment, the half shells 10A, 10B, free of cracking or the like defects, may be obtained by press-forming the tailored blanks 30, previously processed by entirety-heating/partial cooling, thereby completing the manifold converter. Thus, with the subject exemplary embodiment, the number of components or the cost of the feedstock material may be lesser than heretofore, thus improving the yield of material. In addition, the number of working steps may be lessened, while the weld length may be shorter, thus reducing the production cost. Moreover, in the conventional process, the catalyst carrier CAT had to be axially press-fitted into a cylindrically-shaped casing main body 96 (see FIG. 15), from one end towards the opposite end thereof, so that larger numbers of steps are required. In contrast, in the subject exemplary embodiment, the catalyst carrier CAT can be placed within the half-cylindrically shaped parts 16 of the two half shells 10A, 10B simultaneously with the operation of assembling the upper and lower half shells 10A, 10B in contact with each other and joining them together. That is, the operation of interconnecting the two half shells and holding/securing the catalyst carrier CAT in place may be accomplished at the same time by full-circled welding the two half shells. Thus, with the subject exemplary embodiment, it is possible to reduce the production cost.

In the subject exemplary embodiment, the tailored blank 30 is entirety-heated, after which part of the blank is cooled by way of performing partial (local) cooling. However, the partial cooling is made only for necessary minimum zones of the tailored blank 30, and subsequently the metal blank basically improved in elongation performance by heating is mainly pressed. Hence, the formed product obtained suffers from lesser amounts of springback and has higher dimensional accuracy than in case of using simple cold press-forming.

Exemplary Embodiment 2

FIGS. 9 to 14 show Exemplary Embodiment 2 according to the present disclosure. Referring to FIG. 14, a manifold converter of Exemplary Embodiment 2 is featured by an exhaust manifold section 1 formed as a single tube instead of having a plurality of branch pipes 2 and a collecting pipe 3 as in Exemplary Embodiment 1. Such manifold converter, in which the exhaust manifold section 1 is formed of a single tube, without having the multiple cylinder piping parts 2 and the collecting pipe 3, is applied to a new type engine in which the exhaust collecting part which collects exhaust gases from the respective cylinders is formed integrally with an engine side. It is noted that the catalyst casing section 5 of the manifold converter of Exemplary Embodiment 2 is basically the same as Exemplary Embodiment 1. The following explanation, centered about the difference from Exemplary Embodiment 1, schematically illustrates Exemplary Embodiment 2.

The manifold converter of FIG. 14 is again composed by two half shells 50 (an upper half shell 50A and a lower half shell 50B) which is of the form corresponding to vertically (i.e., along a longitudinal splitting line) splitting the completed form into two parts. FIG. 12 shows the upper half shell 50A. In this half shell, a site which will form an exhaust manifold section 1 later on (exhaust manifold forming section) is formed by a tubular (tunnel-shaped) collecting part 53 having a transverse cross-section somewhat flattened out from a semi-arcuate cross-sectional shape. The proximal end of the tubular collecting part 53 connects to a first half-conical part 17. As in Exemplary Embodiment 1, the half shell includes the first half-conical part 17, a half-cylindrically shaped part 16 connecting to the first half-conical part 17, and a second half-conical section 18 connecting to the trailing end of the half-cylindrically shaped part 16. These three sections together make up a catalyst casing forming section (16, 17, 18) of the half shell. A tubular EGR branched part 19 is provided in the second half-conical part 18.

FIG. 9 shows a tailored blank 30 which is the flat plan form prior to press-forming of the half shell as used in Exemplary Embodiment 2. The tailored blank 30 of FIG. 9 is formed of a first iron-based metal blank 31, which is a SUS444 stainless steel sheet of 2.0 mm in thickness, a second iron-based metal blank 32, which is a SUS429 stainless steel sheet of 1.5 mm in thickness, and a third iron-based metal blank 33, which is a SUS429 stainless steel sheet of 1.0 mm in thickness. These three metal blanks are welded, preferably laser-welded together, along respective jointing portions 34.

The tailored blank 30 was then charged into a heating device, for example, an electric or gas heating furnace, and heated in its entirety to a surface temperature of ca. 800 degrees Celsius. The heated blank 30 was taken out from the heating device and put to partial cooling by applying local cooling on local sites of the tailored blank 30. Specifically, as shown in FIG. 10, one or more local sites of the heated tailored blank 30 was contacted from above and below by cooling blocks (61*a*, 61*b*, 62*a*, 62*b*), so that the sites of the tailored blank 30 contacted by the cooling blocks as well as neighboring regions were cooled to ca. 200 degrees Celsius.

FIG. 11 shows the states of surface temperatures of the tailored blank 30 immediately following the partial cooling. FIG. 11 shows the sites of the tailored blank 30 directly contacted with the cooling blocks, and neighboring sites where the temperature is relatively low, that is, relatively low temperature sites C1 and C4, in a dotted pattern. The open (white) region in the tailored blank 30 denotes sites where the temperature is still high. In FIG. 11, the first low-temperature site C1 comes from direct contact with the elongated paired upper and lower cooling blocks 61*a*, 61*b*, and is destined to form the first half-conical part 17 (cone-shaped forming portion) later on as a result of subsequent press-forming. The other low temperature site C4 comes from the contact with the paired upper and lower cooling blocks 62*a*, 62*b*. This low temperature site C4 is destined to form a connection region between the root of the tubular EGR branched part and the half-cylindrically shaped part 16 (casing main body forming portion) by press-forming later on.

After the end of the entirety-heating and partial cooling, the tailored blank 30 is press-formed using the forming die set made up of the fixed die and the movable die, not shown. As a result, the upper shell 50A, including the tubular collecting part 53, first half-conical part 17, half-cylindrically shaped part 16, second half-conical section 18 and the tubular branched portion for EGR 19, is formed, as shown in FIG. 12. It is noted that, in the subject exemplary embodiment, the tubular collecting part 53 and the first half-conical part 17 are formed of the first metal blank 31, and the half-cylindrically-shaped part 16 is formed of the second metal blank 32. The second half-conical part 18 and the tubular EGR branched part 19 are formed of the third metal blank 33. No cracking or the like were observed in any portions of the half shell 50A, such that, despite shape complexities, the product obtained was highly satisfactory with superior dimensional accuracy.

FIGS. 13(A) to 13(C) illustrate a sequence of steps of retention of the catalyst carrier CAT and interconnection of the two half shells 50A, 50B by welding. It is noted that, in FIGS. 13(A) to 13(C), the half shells 50A, 50B are shown in a cross-sectional view with the downstream side half portions (specifically the latter half of the part 16 and the parts 18,19) being removed from the drawing in order to provide for facilitated viewing of the arraying state of the catalyst carrier CAT. That is, the two half shells 50A, 50B are shown as if they are split. Similarly, just the upstream side half portion of the catalyst carrier CAT is shown.

When the upper half shell 50A and the lower half shell 50B have been prepared (see FIG. 13(A)), the catalyst carrier CAT in the form of approximately a column is placed in the interior of the substantially half-cylindrically shaped parts 16 of the half shells 50A, 50B (see FIG. 13(B)). The half shells 50A, 50B are then combined in position around the catalyst carrier (see FIG. 13(C)). Using a clamp jig or the like tool, not shown, the catalyst carrier CAT is compressed from outside the half-cylindrically shaped parts 16 of the half shells 50A, 50B, thereby bringing the inner peripheral surfaces of the half-cylindrically-shaped parts 16 into intimate contact with the outer peripheral surface of the catalyst carrier CAT. While the state of the intimate contact is maintained, the two half shells 50A, 50B are welded (preferably welded all around) on a butting line L of the two half shells 50A, 50B. This completes the overall shape of Exemplary Embodiment 2 of the manifold converter.

In Exemplary Embodiment 2, the advantageous effect, similar to that of the above described Exemplary Embodiment 1, may be achieved.

As mentioned above, although exemplary embodiments, etc. of the present invention were explained, the present invention is not limited to the above-mentioned exemplary embodiments, etc., and the further modification, substitution or adjustment can be added, within a scope not deviating from the fundamental technical idea of the present invention.

The entire disclosures of the above Patent Literatures are incorporated herein by reference thereto. Modifications and adjustments of the exemplary embodiment are possible within the scope of the overall disclosure (including the claims) of the present invention and based on the basic technical concept of the present invention. Various combinations and selections of various disclosed elements (including each element of each claim, each element of each exemplary embodiment, each element of each drawing, etc.) are possible within the scope of the claims of the present invention. That is, the present invention of course includes various variations and modifications that could be made by those skilled in the art according to the overall disclosure including the claims and the technical concept. Particularly, any numerical range disclosed herein should be interpreted that any intermediate values or subranges falling within the disclosed range are also concretely disclosed even without specific recital thereof.

REFERENCE SIGNS LIST

1 exhaust manifold section
2 branch pipe (cylinder pipe)
3 collecting pipe
4 oxygen sensor fitting part
5 catalyst casing section
6 casing main body
7 conical (cone-shaped) part, inlet side shell
8 outlet side shell
9 communication EGR port
10 half shell (upper half shell 10A, lower half shell 10B)
12 tubular (tunnel-shaped) branch part
13 collecting part
14 crotch part
16 half-cylindrically shaped part (casing main body forming part)
17 first half-conical part (first cone-shape forming part)
18 second half-conical part (second cone-shape forming part)
19 tubular (tunnel shaped) EGR branched part
30 tailored blank
31 first (iron-based) metal blank, first metal sheet member
32 second (iron-based) metal blank, second metal sheet member
33 third (iron-based) metal blank, third metal sheet member
34 jointing (overlapping) portion
35 positioning openings
43 hinge structure
44*a*, 44*b*, 45*a*, 45*b*, 46*a*, 46*b*, 47*a*, 47*b* cooling block
48 positioning pin
50 half shell (upper half shell 50A, lower half shell 50B)
53 tubular (tunnel shaped) colleting part, tubular main part
61*a*, 61*b*, 62*a*, 62*b* cooling block
C1, C2, C3, C4 (relatively) low temperature site, local portion
L butting line (part), jointing line, weld line
CAT catalyst carrier

The invention claimed is:

1. A catalyst casing-integrated exhaust manifold including an exhaust manifold section and a catalyst casing section; the catalyst casing section having a cylindrically-shaped casing main body holding a catalyst carrier, a conical part interconnecting the casing main body and the exhaust manifold section, and an outlet side shell connected to a downstream side of the casing main body; wherein, the exhaust manifold section and the catalyst casing section are formed by press-forming of at least one tailored blank, the at least one tailored blank being formed by welding at least two metal blanks which are different in kind of materials and/or different in thicknesses, and wherein the exhaust manifold section and the conical part of the catalyst casing section are formed of the same metal blank.

2. The catalyst casing-integrated exhaust manifold according to claim 1, wherein, the casing main body and the outlet side shell of the catalyst casing section are formed of at least one metal blank which is different from the metal blank forming the exhaust manifold section and the conical part.

3. A method for manufacturing a catalyst casing-integrated exhaust manifold including an exhaust manifold section and a catalyst casing section; the catalyst casing section having a cylindrically-shaped casing main body holding a catalyst carrier, a conical part interconnecting the casing main body and the exhaust manifold section, and an outlet side shell connected to a downstream side of the casing main body;

the method comprising:

A) preparing at least one tailored blank which is formed by welding at least two metal blanks, which are different in kind of materials and/or different in thicknesses, as a metal plate which has a pre-pressing flat plate shape and forms a half shell corresponding to a half shape of a completed catalyst casing-integrated exhaust manifold;

B) entirety-heating the at least one tailored blank up to a high first temperature range that allows quenching when rapidly cooled at a later press-forming;

C) bringing at least one cooling block into contact with at least one local portion including a portion designed to form the conical part through press-forming, on the heated at least one tailored blank, so as to cool the at least one local portion and a neighboring area thereof to a low second temperature range which is lower than the first temperature range such that causes quenching when subjected to the press-forming;

D) press-forming the at least one tailored blank, following the local cooling, so as to impart a three-dimensional form corresponding to the half shell of the catalyst casing-integrated exhaust manifold; and E) butting two of the half shells formed through A) to D), and welding the two half shells at butting portions thereof to complete an overall shape of the catalyst casing-integrated exhaust manifold.

4. The method for manufacturing a catalyst casing-integrated exhaust manifold according to claim 3, wherein, the metal making the at least one tailored blank is such iron-based metal that is not quenched even by rapidly cooling from a high first temperature range of 700 to 950 degrees Celsius to a low second temperature range of 100 to 600 degrees Celsius.

5. The method for manufacturing a catalyst casing-integrated exhaust manifold according to claim 3, wherein, the at least one local portion on the at least one tailored blank, contacted with the at least one cooling block in the local cooling, includes:

at least one site (C1) adapted to form the conical part after press-forming;

at least one site (C2) adapted to form, after the press-forming, at least one crotch part interconnecting sidewall sections disposed at roots of two neighboring tubular branch parts in the exhaust manifold section;

a site (C3) adapted to form, after press-forming, a connection portion between at least one root of the tubular branch part, disposed at at least one outermost lateral side of the exhaust manifold section, and a collecting part at which the tubular branch parts are collected together; and a site (C4) adapted to form, after press-forming, a connection portion between a root of a tubular EGR branch part and the casing main body, on the outlet side shell.

6. The method for manufacturing a catalyst casing-integrated exhaust manifold according to claim 5, wherein the metal making the at least one tailored blank is such iron-based metal that is not quenched even by rapidly cooling from a high first temperature range of 700 to 950 degrees Celsius to a low second temperature range of 100 to 600 degrees Celsius.

7. A method for manufacturing a catalyst casing-integrated exhaust manifold including an exhaust manifold section and a catalyst casing section; the catalyst casing section having a cylindrically-shaped casing main body holding a catalyst carrier, a conical part interconnecting the casing main body and the exhaust manifold section, and an outlet side shell connected to a downstream side of the casing main body;

the method comprising:

A) preparing at least one tailored blank which is formed by welding at least two metal blanks, made of iron-based metal, which are different in kind of materials and/or different in thicknesses, as a metal plate which has a pre-pressing flat plate shape and forms a half shell corresponding to a half shape of a completed catalyst casing-integrated exhaust manifold;

B) entirety-heating the at least one tailored blank up to a high temperature range of 700 to 950 degrees Celsius;

C) bringing at least one cooling block into contact with at least one local portion including a portion designed to form the conical part through pressing, on the heated at least one tailored blank, so as to cool the at least one local portion and a neighboring area thereof to a low temperature range of 100 to 600 degrees Celsius;

D) press-forming the at least one tailored blank, following the local cooling, so as to impart a three-dimensional form corresponding to the half shell of the catalyst casing-integrated exhaust manifold; and E) butting two of the half shells formed through the steps A to D, and welding the two half shells at butting portions thereof to complete an overall shape of the catalyst casing-integrated exhaust manifold.

8. The method for manufacturing a catalyst casing-integrated exhaust manifold according to claim 7, wherein, the iron-based metal making the at least one tailored blank is such iron-based metal that is not quenched even by rapidly cooling from the high temperature range of 700 to 950 degrees Celsius to the low temperature range of 100 to 600 degrees Celsius.

9. The method for manufacturing a catalyst casing-integrated exhaust manifold according to claim 7, wherein, the at least one local portion on the at least one tailored blank, contacted with the at least one cooling block in the local cooling, includes:

at least one site (C1) adapted to form the conical part after press-forming; and at least one of the following sites:

at least one site (C2) adapted to form, after the press-forming, at least one crotch part interconnecting side-wall sections disposed at roots of two neighboring tubular branch parts in the exhaust manifold section;

a site (C3) adapted to form, after press-forming, a connection portion between at least one root of the tubular branch part, disposed at at least one outermost lateral side of the exhaust manifold section, and a collecting part at which the tubular branch parts are collected together; and a site (C4) adapted to form, after press-forming, a connection portion between a root of a tubular EGR branch part and the casing main body, on the outlet side shell.

10. The method for manufacturing a catalyst casing-integrated exhaust manifold according to claim 9, wherein the iron-based metal making the at least one tailored blank is such iron-based metal that is not quenched even by rapidly cooling from the high temperature range of 700 to 950 degrees Celsius to the low temperature range of 100 to 600 degrees Celsius.

* * * * *